US007292801B2

(12) United States Patent
Yoshikawa

(10) Patent No.: US 7,292,801 B2
(45) Date of Patent: Nov. 6, 2007

(54) FIXING DEVICE, FIXING METHOD, IMAGE FORMING APPARATUS, IMAGE FORMING METHOD

(75) Inventor: Takahiro Yoshikawa, Sagamihara (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/873,132

(22) Filed: Jun. 23, 2004

(65) Prior Publication Data

US 2004/0264991 A1 Dec. 30, 2004

(30) Foreign Application Priority Data

Jun. 26, 2003 (JP) ..... 2003-183159

(51) Int. Cl.
*G03G 15/20* (2006.01)

(52) U.S. Cl. ..... 399/69; 399/328; 399/67; 399/330; 219/216

(58) Field of Classification Search ..... 399/69
See application file for complete search history.

(56) References Cited

U.S. PATENT DOCUMENTS

| | | | | |
|---|---|---|---|---|
| 6,333,490 | B1 * | 12/2001 | Higashi et al. | 219/216 |
| 6,463,252 | B2 * | 10/2002 | Omoto et al. | 399/330 |
| 6,753,515 | B2 * | 6/2004 | Miyahara et al. | 219/619 |
| 2003/0099478 | A1 * | 5/2003 | Okano | 399/69 |
| 2003/0190170 | A1 * | 10/2003 | Hamada et al. | 399/69 |
| 2004/0028423 | A1 * | 2/2004 | Hashiguchi et al. | 399/69 |

FOREIGN PATENT DOCUMENTS

| | | |
|---|---|---|
| JP | 05-134575 | 5/1993 |
| JP | 2001-249570 | 9/2001 |
| JP | 2003-107937 | 4/2003 |
| JP | 2003-107954 | 4/2003 |

OTHER PUBLICATIONS

U.S. Appl. No. 10/441,006, filed May 20, 2003, Yoshikawa.
U.S. Appl. No. 10/873,132, filed Jun. 23, 2004, Yoshikawa.
U.S. Appl. No. 11/354,146, filed Feb. 15, 2006, Yoshikawa.
U.S. Appl. No. 11/376,159, filed Mar. 16, 2006, Yoshikawa.
U.S. Appl. No. 11/521,506, filed Sep. 15, 2006, Yoshikawa.

* cited by examiner

*Primary Examiner*—David M. Gray
*Assistant Examiner*—Ryan D. Walsh
(74) *Attorney, Agent, or Firm*—Oblon, Spivak, McClelland, Maier & Neustadt, P.C.

(57) ABSTRACT

A fixing device including a rotation body and a facing unit configured to face the rotation body. The fixing device also includes a first heat unit configured to heat a nipping area that is formed between the rotation body and the facing unit. A second heat unit is also provided to heat the nipping area. The fixing device further includes a high heat capacity unit configured to transfer the heat from the first heat unit to the nipping area and a low heat capacity unit configured to transfer the heat from the second heat unit to the nipping area. A heat quantity controller is configured to control heat quantity of the first heat unit and the second heat unit. The first heat unit is also configured to heat the nipping area such that the heat quantity per unit area in edge portions of the nipping area is higher than the heat quantity per unit area of the center portion of the nipping area. The second heat unit is also configured to heat the nipping area such that the heat quantity per unit area in the edge portions of the nipping area is lower than the heat quantity per unit area in the center portion of the nipping area.

11 Claims, 9 Drawing Sheets

FIXING DEVICE, FIXING METHOD, IMAGE FORMING APPARATUS, IMAGE FORMING METHOD

CROSS-REFERENCE TO RELATED APPLICATION

The present application claims priority to Japanese application no. 2003-183159, filed in the Japanese Patent Office on Jun. 26, 2003, the disclosure of which is incorporated by reference herein in its entirety.

BACKGROUND OF THE INVENTION

1. Field of the Invention

The present invention relates to a fixing device, a fixing method, an image forming apparatus, and an image forming method.

2. Description of the Related Art

A known fixing device is arranged in an image forming apparatus that uses electro-photographic technology. The fixing device fixes a toner image that is electro-statically supported on a sheet by means of pressure and heat, and includes a fixing roller and a press roller that contacts and exerts pressure on the fixing roller. A heating device, including a heater, provides heat to at least one of the fixing roller and the press roller. Accordingly, a nipping area where the fixing roller and the press roller contact each other is heated, and the toner image formed on the sheet that passes through the nipping area is fixed on the sheet.

The fixing device includes a temperature detecting device that is arranged, for example, on the central part of the rotation axis of the fixing roller. When a sheet passes through the nipping area, the sheet draws heat from the fixing roller. Thus, power from the heater must be controlled to compensate for the heat drawn by the passing sheet. In this manner, the temperature of the nipping area is kept at a predetermined temperature.

In this known configuration, a problem exists in that the temperature of edges of the fixing roller gradually increase when many sheets continuously pass through the nipping area, because the sheets do not contact the edges of the fixing roller and, thus, do not draw heat from the edges of the fixing roller. When the amount of heat around the edges of the fixing roller is set to be lower to avoid this problem, the temperature of the edges of the fixing roller can become too low during the standby time of the fixing device. During standby, the heat of the edges of the fixing roller is transmitted to side walls through bearings of the fixing roller and through a gear fixed to the frame of the fixing roller. Due to the low edge temperature, the portions of a toner image positioned on the parts of a sheet that contact the area around the edges of the fixing roller are not fixed well.

Japanese Patent Publication No. 05-134575 ("JP '575") describes a fixing device designed to address this problem. The fixing device is arranged in a copier and includes a fixing roller and a press roller that contacts and exerts pressure on the fixing roller, thereby forming a nipping area between these two rollers. The fixing device also includes a temperature control device. A first heater and a second heater, each of them being a halogen heater, are arranged in the fixing roller. The temperature control device detects the temperature of the surface of the fixing roller. The first heater can be controlled such that that heat in the portion of the fixing roller surface on which the sheet does not pass is lower than heat in other portions of the fixing roller surface. The second heater can be controlled such that heat in the portion of the fixing roller surface on which the sheet does not pass is higher than heat in other portions of the fixing roller surface.

In the fixing device of JP '575, electric power is supplied to the first heater and the second heater when the power of the copier is ON. When the temperature control device detects that the temperature of the surface of the fixing roller reaches a predetermined temperature, as a result of receiving heat from both the first heater and the second heater, the first heater is turned off and only the second heater continues to heat the fixing roller. The copier remains in this standby state until a sheet passes through the nipping area of the fixing device.

When a copy button of the copier is pressed, the second heater is turned off while the first heater is turned on. During a copying operation, only the first heater heats the fixing roller and controls the temperature of the fixing roller such that the temperature is kept a predetermined level. After the coping operation finishes, the copier reverts to the standby state and the fixing roller is heated only by the second heater.

However, the fixing device of JP '575 suffers from several problems, especially when a fixing belt is arranged around the fixing roller, and when the nipping area is formed between the fixing belt and the press roller.

For example, when the copier is in the standby state, the temperatures of the edge of the fixing roller and the press roller generally become lower, because heat from the fixing roller and the press roller is transmitted to side walls through bearings that support these rollers, as described above. When a heat roller and the fixing belt are made of materials having high heat conduction, heat from the press roller and the fixing roller is radiated through the heat roller and the fixing belt.

Accordingly, when fixing is started, the temperature of the edges of the fixing belt is lower than is necessary to properly fix a toner image to areas of a sheet contacting the edges of the fixing belt.

In order to avoid the problem, the heat quantity of the heater in the part that heats the edge of the press roller is set higher. The temperature of the part of the fixing belt, which a sheet contacts when the sheet passes through the nipping area, does not become too high because the sheet draws heat from the fixing belt. However, the temperature of the edge of the fixing belt, which contacts the outer edges of passing sheets, becomes too high with continuous sheet passing.

In addition, the wattage of the heater in the press roller must be continuously increased to maintain the temperature of the center of the nipping area in a range that is enough for fixing, even when sheets continuously pass through the nipping area. Therefore, the fixing device consumes much electricity during operation.

SUMMARY OF THE INVENTION

It is an object of the present invention to provide for the forming of images on recording sheets while avoiding the above-described drawbacks of known image forming systems.

In order to achieve the above mentioned object, an aspect of the present invention provides a fixing device including a rotation body and a facing unit configured to face the rotation body. The fixing device also includes a first heat unit and a second heat unit, both configured to heat a nipping area that is formed between the rotation body and the facing unit. A high heat capacity unit provided in the fixing device is configured to transfer heat from the first heat unit to the nipping area. Also provided is a low heat capacity unit configured to transfer heat from the second heat unit to the nipping area. A heat quantity controller is provided to control heat quantity of the first heat unit and the second heat unit. The first heat unit is also configured to heat the nipping area such that the heat quantity per unit area in an edge part of the nipping area is higher than the heat quantity per unit area of the center part of the nipping area. The second heat unit is also configured to heat the nipping area such that the heat quantity per unit area in the edge part of the nipping area is lower than the heat quantity per unit area in the center part of the nipping area.

In accordance with another aspect of the present invention, a fixing device is provided that includes means for rotating and means for facing the means for rotating. The fixing device also includes a first heating means and a second heating means, both for heating a nipping area that is formed between the means for rotating and the means for facing. Also provided is high heat capacity means for transferring heat from the first heating means to the nipping area. The fixing means further includes low heat capacity means for transferring heat from the second heating means to the nipping area. Controlling means is provided for controlling heat quantity of the first heating means and the second heating means. The first heating means is also for heating the nipping area so that the heat quantity per unit area in an edge part of the nipping area is higher than the heat quantity per unit area of the center part of the nipping area. The second heating means is also for heating the nipping area so that the heat quantity per unit area in the edge part of the nipping area is lower than the heat quantity per unit area in the center part of the nipping area.

In accordance with a further aspect of the present invention, an image forming device is provided that includes a fixing device of one of the above-described aspects.

In accordance with another aspect of the present invention, a fixing method is provided. The fixing method includes providing a rotation body, a facing unit configured to face the rotation body, a high heat capacity unit, and a low heat capacity unit. The fixing method also includes heating a nipping area that is formed between the rotation body and the facing unit through the high heat capacity unit while controlling the heat quantity such that the heat quantity per unit area in an edge part of the nipping area is higher than the heat quantity per unit area of a center part of the nipping area. The fixing method further includes heating the nipping area through the low heat capacity unit while controlling the heat quantity such that the heat quantity per unit area in the edge part of the nipping area is lower than the heat quantity per unit area in the center part of the nipping area.

In accordance with a further aspect of the present invention, an image forming method is provided that includes the above-described fixing method.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings.

DETAILED DESCRIPTION OF THE PREFERRED EMBODIMENTS

Figure 1:
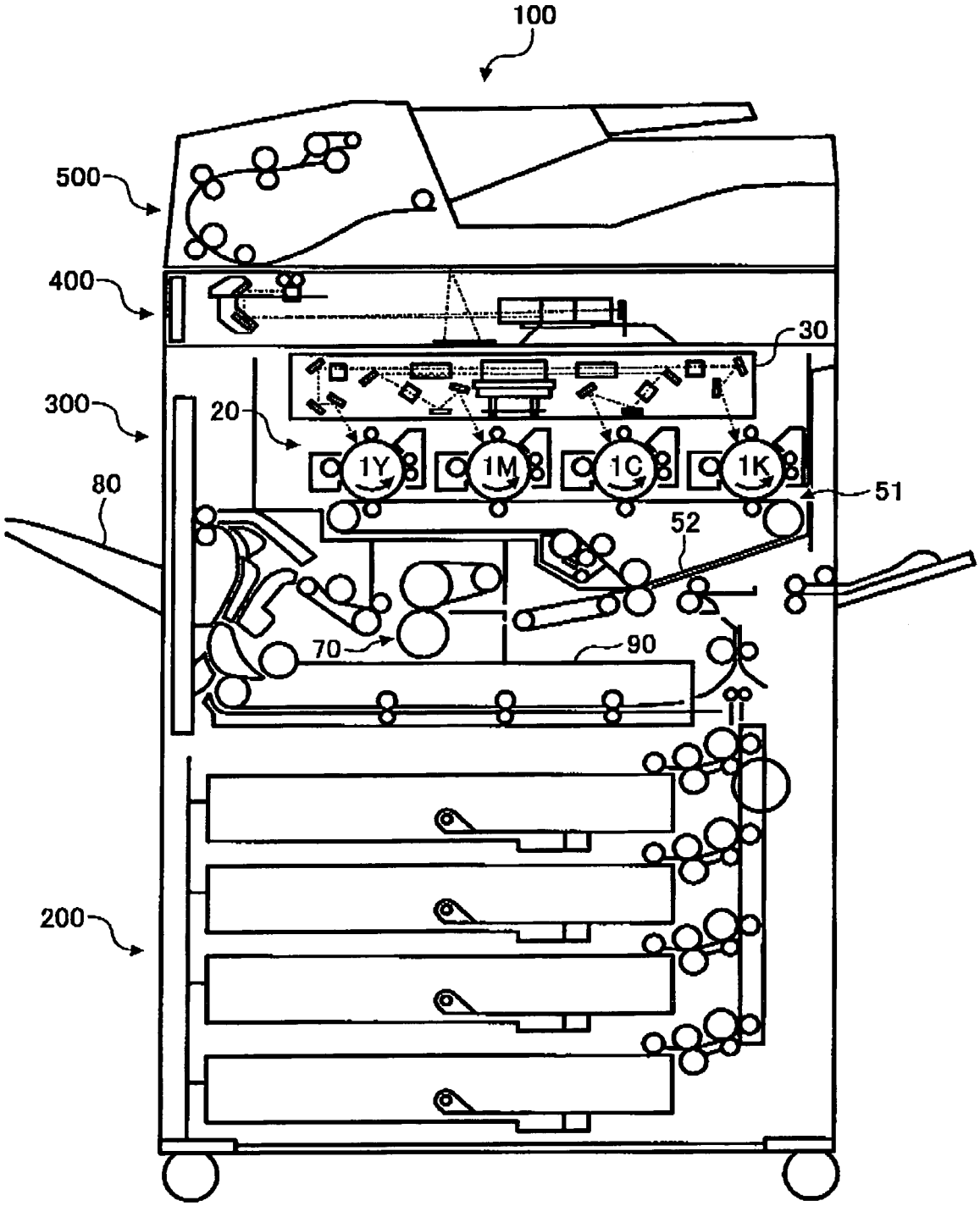
FIG. 1 is a side view of an image forming apparatus according to an aspect of the present invention.

Referring now to the drawings, wherein like reference numerals designate identical or corresponding parts throughout the several views.

FIG. 1 illustrates an image forming apparatus 100 arranged as a color copier. Alternatively, the image forming apparatus 100 can be arranged as printer, a monochromatic copier, or any other apparatus for forming images. The image forming apparatus 100 includes an image forming unit 300, a sheet feeding unit 200, and an original document reading unit 400. The image forming unit 300 includes an image forming device 20, a light exposure device 30, a transfer device 51, and a fixing device 70.

The image forming device 20 includes four image forming assemblies, each of which forms a toner image whose color is black (K), cyan (C), magenta (M), and yellow (Y). Each of the image forming assemblies includes one of the photoconductors 1Y, 1M, 1C, and 1K, a charging device, a developing device, and a cleaning device. The photoconductors 1Y-1K are arranged in the center part of the image forming assemblies, and the charging devices, the developing devices, and the cleaning devices are arranged around the photoconductors 1Y-1K, respectively.

The exposure device 30 generates optical signals based on image signals, including signals read by the original document reading unit 400 and signals sent from an outside device (e.g. a personal computer). The exposure device 30 uses the optical signals to form latent images on the photoconductors 1Y-1K.

The transfer device 51 includes an intermediate transfer belt 52 onto which toner images, formed on the surface of each of the photoconductors 1Y-1K, are transferred in an overlapping manner. The intermediate transfer belt 52 transfers an overlapped image onto a sheet. Alternatively, the transfer device 51 can include a transfer convey belt that transfers toner images onto sheets directly from photoconductors 1Y-1K.

The fixing device 70, which is discussed in more detail below, includes a press roller and a belt that is placed around a roller in which a heater is placed. A toner image on a sheet is fixed by heat and pressure in a nipping area that is formed between the belt and the press roller.

The image forming apparatus also includes a sheet reversal unit 90 for double-sided copying and a sheet discharging tray 80.

Figure 2:
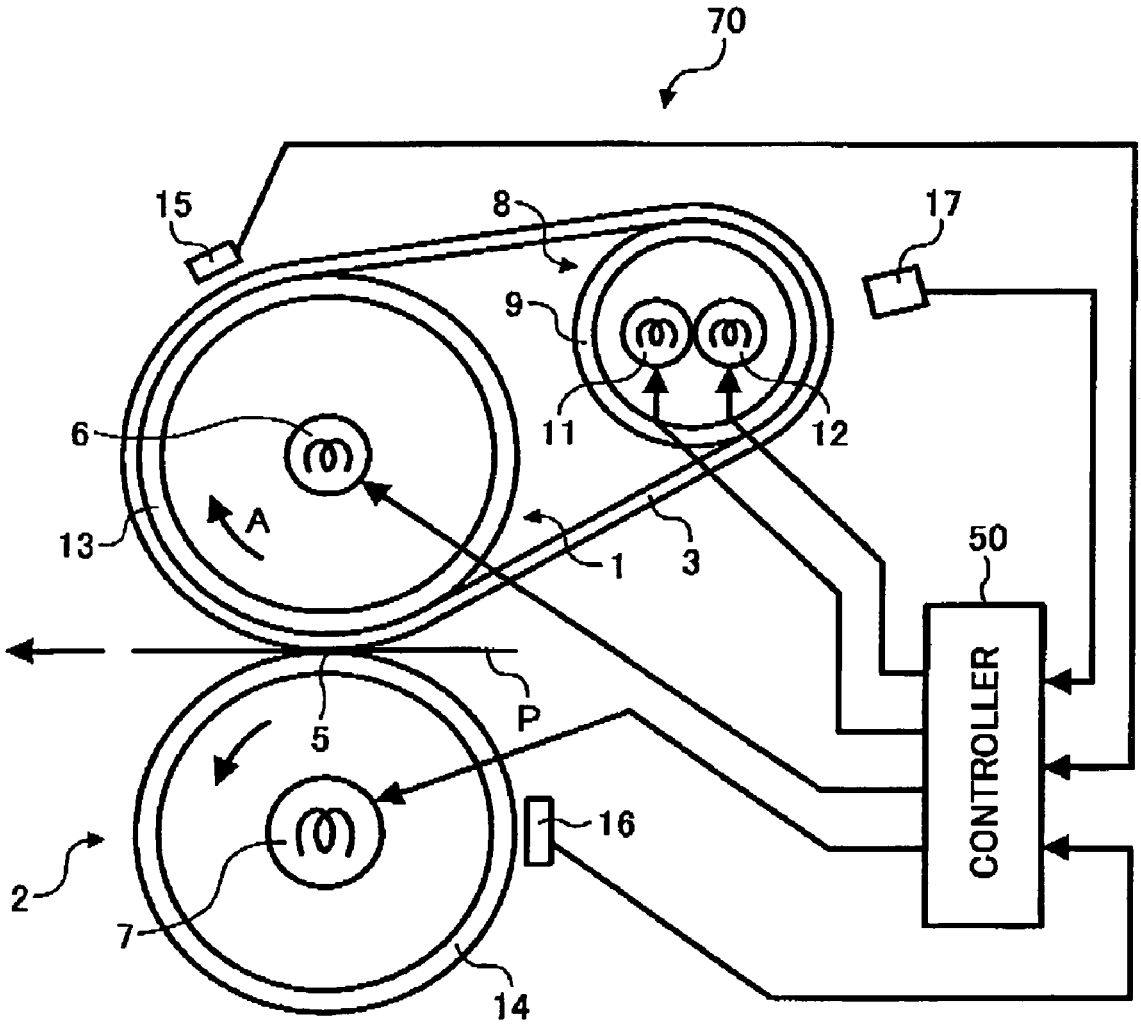
FIG. 2 is a schematic view of a fixing device in accordance with the aspect of the present invention.

FIG. 2 illustrates in detail the fixing device 70, which includes a fixing roller 1 as a rotation body, a press roller 2 as a facing unit that faces the fixing roller 2, and a heat device. The heat device includes heaters 6, 7, 11 and 12, and is configured to heat the nipping area that is formed by the press roller 2 and the fixing belt 3. Alternative to the configuration shown in FIG. 2, in which both heaters 6 and 7 are provided, the fixing device 70 can include only one of the heaters 6 and 7. The heater 6 is arranged in the fixing roller 1, the heater 7 is arranged in the press roller 2, and the heaters 11 and 12 are arranged in the heat roller 8. Each of the heaters 6, 7, 11, and 12 serves as a heat source.

As shown in the FIG. 2, the heat roller 8 is arranged away from the fixing roller 1 with respect to the press roller 2, and the fixing belt 3 is placed around the fixing roller 1 and the heat roller 8 such that a tension in created in the fixing belt 3.

The surface of the fixing roller 1 is covered with a rubber layer 13 made of a rubber material, such as silicon rubber. The rubber layer 13 acts as a high heat capacity unit and is coated with a fluoro resin. The surface of the press roller 2 is covered with a rubber layer 14 made of a rubber material, such as silicon rubber. The rubber layer 14 acts as a high heat capacity unit and is coated with a fluoro resin. In contrast, the heat roller 8 includes a low heat capacity component in the form of a metal pipe 9 made of a metal material. The metal material can include, for example, nickel (Ni) and stainless steel (SUS). In addition, the surface of the heat roller 8 is not covered with a rubber material, unlike the fixing roller 1 and the press roller 2. The heat capacity of the low heat capacity component (i.e., the metal pipe 9) is lower than the heat capacities of the high heat capacity components (i.e., the rubber layers 13 and 14), and a heat capacity ratio of the low heat capacity unit to the high heat capacity unit can be equal to or greater than 1:3.

The fixing belt 3 includes a base layer, an elastic layer, and a surface layer. The base layer is formed as a film made of a metal material (e.g., including nickel and stainless) or a resin (e.g., including PI and PAI). The elastic layer is made of a rubber material including, for example, silicon rubber. The surface layer is made of fluoro resin. The heat capacity of the fixing belt 3 is relatively low and lower than the high heat capacity units 13 and 14.

The fixing belt 3 moves according to the rotation of the fixing roller 1, which is driven by a drive source (not shown) in a clockwise direction, as indicated by an arrow A in FIG. 2.

Figure 4:
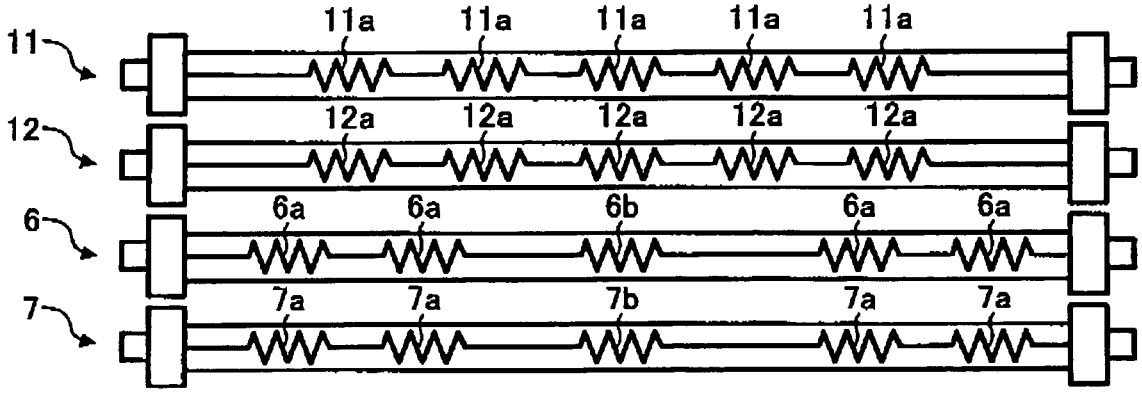
FIG. 4 is a detailed schematic view of the heaters of FIG. 3.

The heaters 6 and 7 respectively include high heat parts 6*a* and high heat parts 7*a*, as shown in FIG. 4. The high heat parts 6*a* and 7*a* are respectively positioned in the edge portions of the heaters 6 and 7 with respect to the direction of the rotation axis of the fixing roller 1 and the press roller 2. The heaters 6 and 7 also respectively include a low heat part 6*b* and a low heat part 7*b* in the center portions of the heaters 6 and 7 with respect to the direction of the rotation axis of the fixing roller 1 and the press roller 2. Due to the configuration shown in FIG. 4, the heat quantity per unit area of the heaters 6 and 7 is higher in the edge portions than in the center portions.

Figure 6:
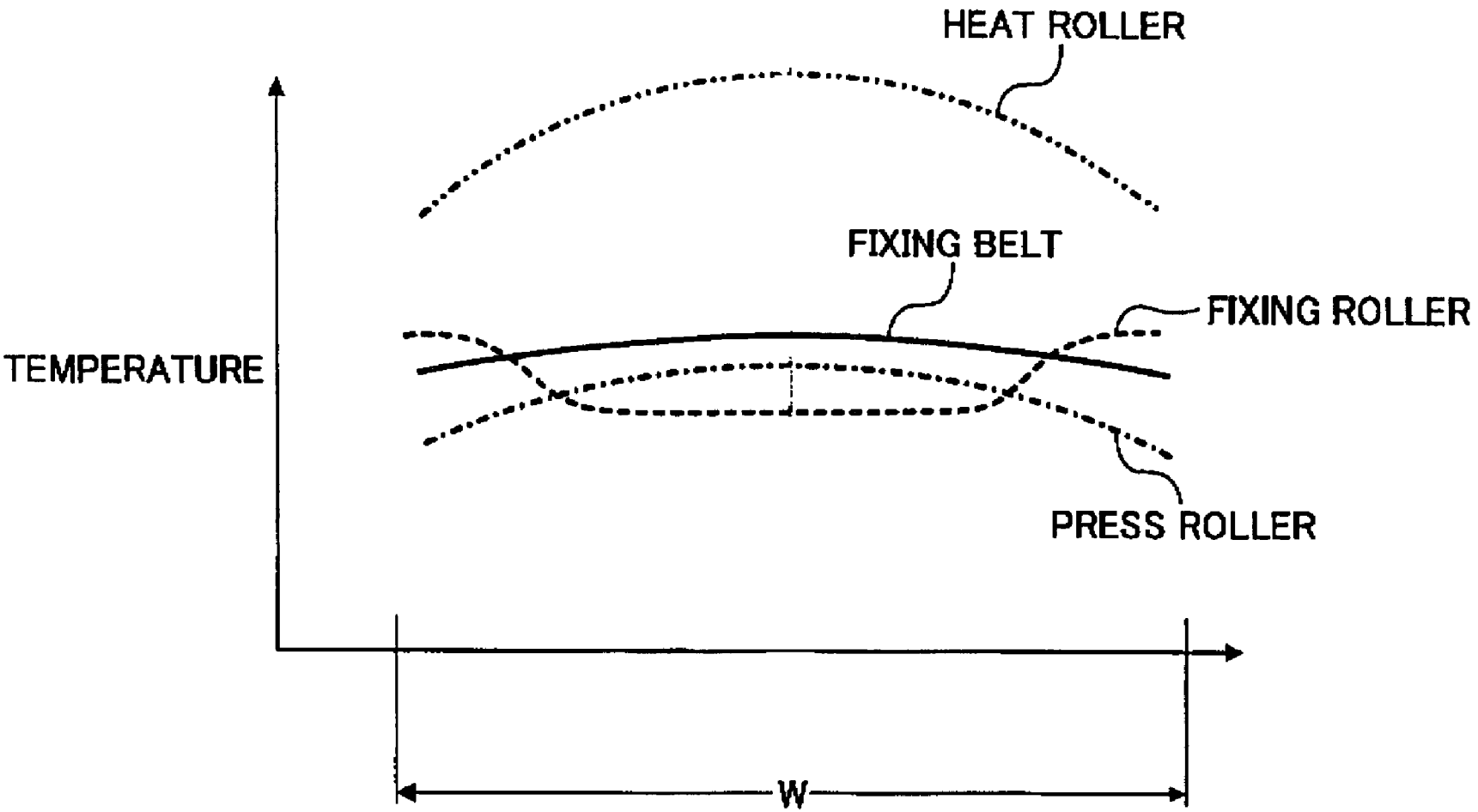
FIG. 6 is a chart indicating the distribution of temperature regarding each of the fixing roller, the press roller, the fixing belt, and the heat roller of FIG. 2.

The heaters 11 and 12 respectively include heat parts 11*a* and heat parts 12*a*. Unlike high heat parts 6*a* and 7*a*, the heat parts 11*a* and 12*a* are not positioned in edge portions of the heaters 11 and 12 with respect to the direction of the rotation axis of the heat roller 8. Accordingly, the heat quantity per unit area of the heat roller 8 is lower in the edge portions than in the center portion. FIG. 6 illustrates the heat distribution of the fixing roller 1, the press roller 2, the fixing belt 3, and the heat roller 8.

As described above, each of the heaters 6, 7, 11 and 12 exhibits different heat quantities per unit area depending on position with respect to the direction of the rotation axis of the associated roller. The heaters 6, 7, 11, and 12 can heat both of the edge portions and the center portion of the nipping area 5 of the fixing belt 3 shown in FIG. 2. The relationship between the heat quantity per unit area of the edge portions and of the center part of the nipping area 5 can be controlled by selectively turning on or off the heaters 6, 7, 11, and 12.

The heaters 6 and 7 serve as a first heat unit that heats the nipping area 5 through the rubber layers 13 and 14 such that heat quantity is higher in the edge portions relative to the center portion in the direction of the rotation axis of the fixing roller 1 and the press roller 2. The second heat unit includes heaters 11 and 12, and heats the nipping area 5 through the metal pipe 9 and the fixing belt 3 such that heat quantity is lower in the edge portions relative to the center portion in the direction of the rotation axis of the heat roller 8.

Figure 3:
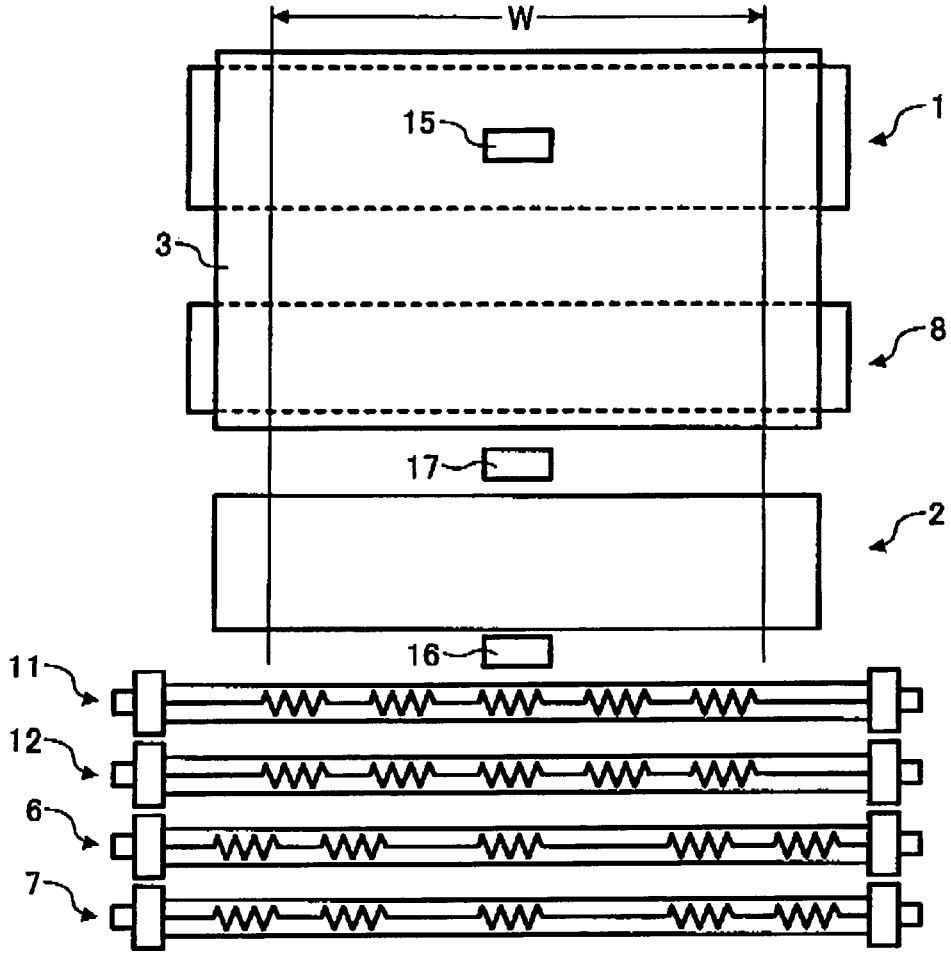
FIG. 3 is a schematic view of a fixing roller, a press roller, heat roller, and heaters of the fixing device of FIG. 2.

A temperature sensor 15 is arranged near the surface of the fixing belt 3, as shown in FIGS. 2 and 3. The temperature sensor 15 detects the temperature of the surface of the fixing belt 3 in the portion around the fixing roller 1. A temperature sensor 16 and a temperature sensor 17 are respectively arranged near the surface of the press roller 2 and the portion of the fixing belt 3 around the heat roller 8. The temperature sensor 17 detects the temperature on the surface of the fixing belt 3 in the portion around the heat roller 8. The temperature sensors 15, 16 and 17 are respectively arranged near the center portions of the rotation axis of the rollers 1, 2, and 8.

The fixing device 70 includes a controller 50 that serves as heat quantity controller. The controller 50 controls the heaters 6 and 7 (the first heat unit) and the heaters 11 and 12 (the second heat unit) such that the value of the heat quantity per unit area of the edge portions of the nipping area 5 minus the heat quantity per unit area of the center portion of the nipping area 5 when the sheet P does not pass through the nipping area 5 is greater than the value of the heat quantity per unit area of the edge portions minus the heat quantity per unit area of the center portion when the sheet P does pass through the nipping area 5. That is, the controller 50 controls the heaters 6, 7, 11, and 12 such that the amount by which the temperatures of the edge portions are greater than the temperature of the center portion when the sheet P is not positioned in the nipping area 5 is larger than the amount by which the temperatures of the edge portions are greater than the temperature of the center portion when the sheet P is positioned in the nipping area 5. In addition, the timing of control by the controller 50 can be based on information from a sensor (not shown) that detects whether the sheet P is about to be fed into the nipping area 5. The sensor can be arranged in a device including the sheet feeding unit 200, a register roller (not shown) of the transfer device 51, or the fixing device 70.

The controller 50 includes a microcomputer, which includes a CPU that executes various determination and information processing operations. The microcomputer also includes a ROM that stores processing programs and invariable data, a RAM including a data memory that stores processing data, and an input and output (I/O) circuit. Each of the temperature sensors 15, 16, and 17 sends a signal corresponding to a detected temperature to the controller 50.

The controller 50 recognizes the detected temperature of each temperature sensors 15, 16, and 17, and controls each of the heaters 6, 7, 11, and 12 such that the detected temperature become closer to a predetermined temperature.

The sheet P, on which a toner image is electrostatically supported, is fed into the nipping area 5. The nipping area 5 is formed where the fixing roller 1 and the press roller 2 press against one another across the fixing belt 3. Due to the pressure created between the fixing roller 1 and the press roller 2, the rubber layers 13 and 14 are deformed in the nipping area 5.

The toner image is fixed onto the sheet P when the sheet P passes through the nipping area 5, due to heat and pressure from the fixing belt 3 and the press roller 2. The fixing belt 3 contacts the rubber layers 13 and 14 when the sheet P contacts the heated fixing belt 3, and heat of the fixing belt 3 is transferred mostly to the sheet P, as the rubber layers 13 and 14 have high heat capacity and low heat conduction.

At the same time, there exists a large influence of the fixing roller 1 and the press roller 2, if the temperature of the fixing roller 1 and the press roller 2 are low when the sheet P starts to be fed into the nipping area 5 after the standby state in which the image forming operation is not executed. This is also due to the rubber layers 13 and 14 having high heat capacity and low heat conduction.

Figure 5:
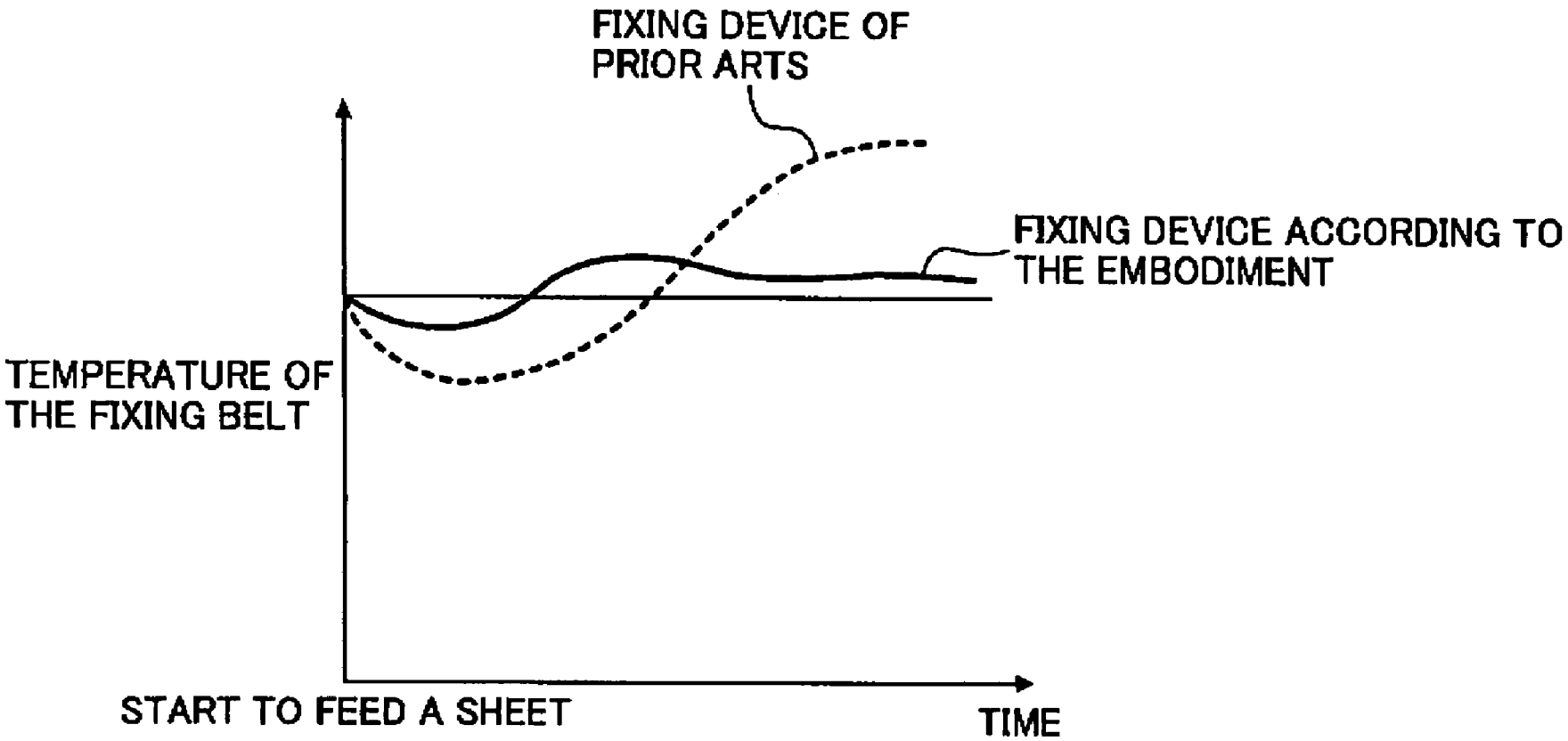
FIG. 5 is a chart comparing temperature of a prior art fixing belt with temperature of the fixing belt shown in FIGS. 2 and 3.

The fixing belt 3 and the heat roller 8 have low heat capacity and high heat conduction and, as such, the temperature of the fixing belt 3 largely depends on the temperature of the fixing roller 1 and the press roller 2 immediately after the fixing belt 3 starts to move. Accordingly, the temperature of the fixing belt 3 tends to decrease if temperature of the fixing roller 1 and the press roller 2 is low, as indicated by the broken line in FIG. 5. In addition, FIG. 5 compares the relationship between time and surface temperature for a known fixing belt to that of an aspect of the present invention.

Further, when the image forming apparatus 100 is in standby state, heat in the edges of the fixing roller 1, the press roller 2, and the heat roller 8 is transferred to side walls through bearings that rotatably support each roller and through gears fixed to each of the support frames of the rollers. Accordingly, a toner image supported on portions of the sheet P that contact near the edges of the nipping area 5 may not be properly fixed when the sheet P is fed into the nipping area 5.

However, the controller 50 controls the heaters 6, 7, 11, and 12 such that the value of the heat quantity in the edge portions of the nipping area 5 minus the heat quantity in the center portion of the nipping area 5 when the sheet P is not positioned in the nipping area is greater than the value of the heat quantity in the edge portions minus the heat quantity in the center portion when the sheet P is positioned in the nipping area 5. Accordingly, the temperature decrease in the edge portions of the fixing belt 3 of the nipping area 5 becomes relatively small.

That is, the controller 50 turns on at least one of the heaters 6 and 7 (for example, the one whose heat capacity is higher) such that the heat quantity per unit area is higher in the edge portion than in the center portion in the direction of the rotation axis of the respective roller. Accordingly, the temperature in the edge portions of the nipping area 5 does not depend largely on the temperature of the fixing belt 3 and the heat roller 8 whose heat capacity is low. Also, the temperature in the edge portions of the nipping area 5 does not decrease to a temperature at which the toner image on the sheet P may not be properly fixed.

The control of the controller 50 after the sheet P is fed into the nipping area 5 will now be described.

In FIG. 3, a width W indicates the largest usable sheet width for the image forming apparatus 100. In addition, the sheet P is arranged in the nipping area 5 so that the center of the sheet width falls on the center of the nipping area 5 in the direction of the rotating axis of the rollers. Accordingly, the sheet P does not contact the outer portions of the fixing belt 3, which corresponds to portions located outside of the width W, even when the sheet P has a maximum usable width of W.

When the sheet P passes through the nipping area 5, the heaters 11 and 12 are powered on and the heaters 6 and 7 are powered off. The sheet P draws heat away from the fixing belt 3 while the sheet P passes through the nipping area 5 and contacts the fixing belt 3. However, because the sheet P does not contact and draw heat away from the outer edge portions of the fixing belt 3, the temperature of these portions remains high. When the sheet P contacts the nipping area 5 of the fixing belt 3, heat from the fixing belt 3 is transferred mostly to the sheet P, although the fixing belt 3 contacts the rubber layer 13 of the fixing roller 1 and the rubber layer 14 of the press roller 2. That is due to the large heat capacity of the rubber layers 13 and 14.

Because the sheet P does not draw heat from the outer edge portions of the fixing belt 3, and if the heaters 11 and 12 continue to heat the outer portions of the fixing belt 3, the temperature of the outer portions of the fixing belt 3 will become too high, especially when the sheets continuously pass through the nipping area 5.

If the heaters 6 and 7 are powered on and continue to heat the fixing belt 3 when the sheet P enters the nipping area 5, the heat from the heaters 6 and 7 is not immediately transferred to the fixing belt 3 due to the low heat conduction of the rubber layers 13 and 14. Accordingly, it is possible that the temperature of the center portion of the fixing belt 3 decreases to a temperature at which toner images can not be properly fixed to sheets P when multiple sheets continuously pass continuously through the nipping area 5. This is due to the heat quantity transferred from the heaters 6 and 7 to the fixing belt 3 being less than the heat quantity drawn by sheets P from the fixing belt 3.

Consequently, the controller 50 controls the heaters 11 and 12 to be powered on and the heaters 6 and 7 to be powered off when the sheet P is fed into the nipping area 5.

By using the above-described configuration, the heat quantity per unit area that is transferred to the fixing belt 3 becomes higher in the center portion than in the edge portions of the fixing belt 3. This is because the heaters 11 and 12 do not include heat parts 1 a and heat parts 12*a* in edge portions with respect to the direction of the rotation axis of the heat roller 8, such that the heat quantity per unit area of the heat roller 8 is lower in the edge portions than in the center portion, as shown in FIG. 4.

Accordingly, a large increase of temperature in the outer portions of the fixing belt 3 can be avoided, even when multiple sheets P continuously pass through the nipping area 5, because the outer portions of the fixing belt 3 are heated less when the sheet P passes through the nipping area 5. The heat from the heaters 11 and 12 can be transferred to the fixing belt 3 through the heat roller 8 immediately, as the heat roller 8 includes the metal pipe 9. The metal pipe 9, as described above, exhibits relatively high heat conduction and does not have rubber layer.

Accordingly, heat from the heaters 11 and 12 can compensate for heat drawn by the sheet P within the width W, even when sheets P continuously pass through the nipping area 5. Thus, the temperature of the nipping area 5 of the fixing belt 5 can be kept within a predetermined temperature range for fixing toner and the above-described problems associated with fixing toner images onto sheets can be avoided.

As described above, when the sheet P passes through the nipping area 5, the heaters 11 and 12 are powered on and the heaters 6 and 7 are powered off. Accordingly, only the heaters 11 and 12 consume electricity for heating in the fixing device 70 when the sheet P passes through the nipping area 5. In addition, heat from the heaters 11 and 12 is transferred efficiently through the metal pipe 9 to the fixing belt 3. Accordingly, by the above-described aspect of the present invention, the electricity consumption of the fixing device 70 is decreased.

In this way, fixing characteristics can be improved, especially in the edge portions of the nipping area 5, and electricity consumption of the fixing device 70 can be decreased when the sheet P passes through the nipping area 5.

Figure 7:
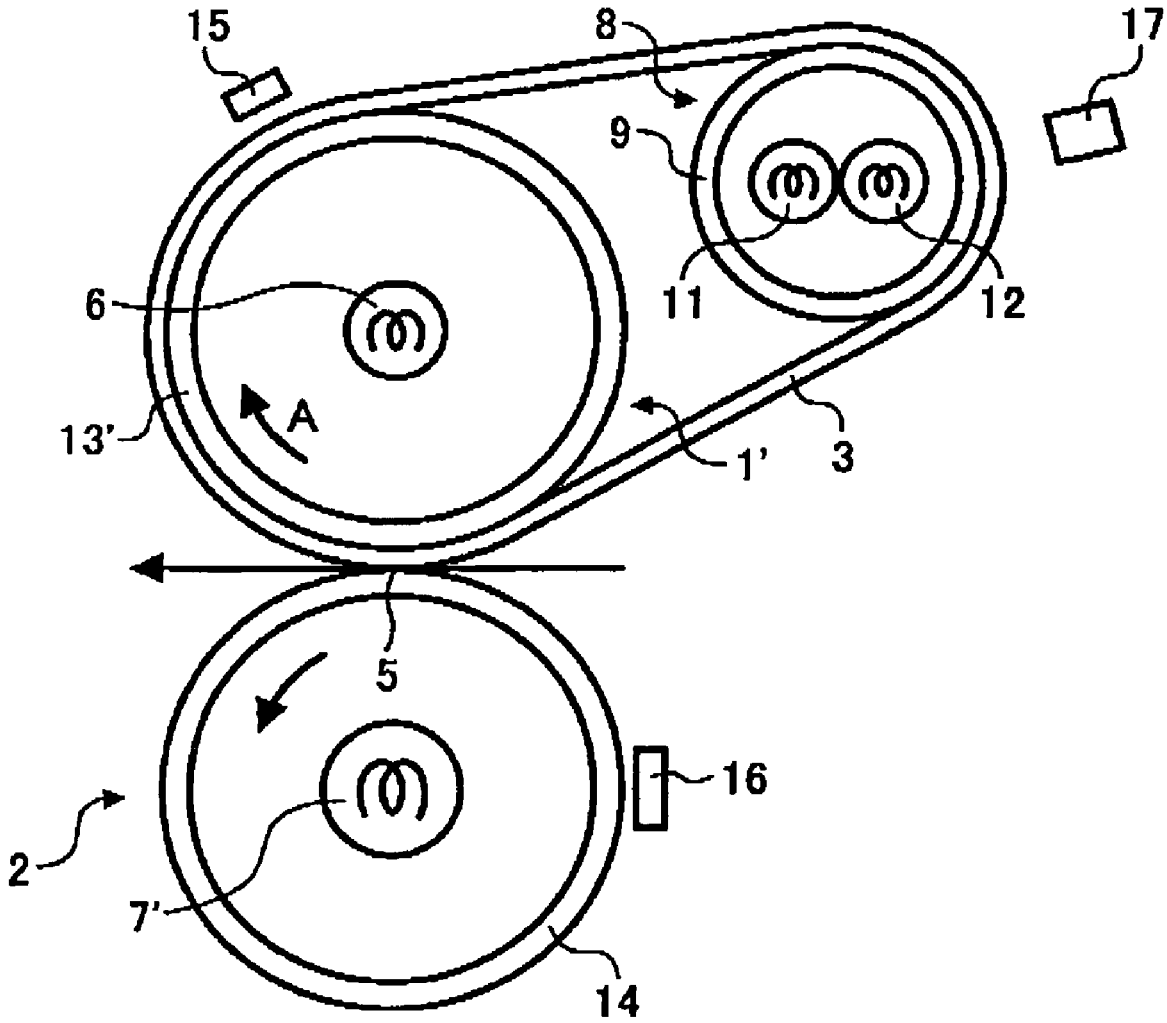
FIG. 7 is a schematic view of a fixing device in accordance with a further aspect of the present invention.

FIG. 7 illustrates a fixing device 70 in accordance with another aspect of the present invention. In this aspect, a heater 6 serves as a first heat unit and is arranged in one of the fixing roller 1' and the press roller 2. The heat capacity of the fixing roller 1' is higher than that of the press roller 2 in this aspect. The heat quantity per unit area of the heater 6 is higher in edge portions than in a center portion with respect to the direction of the rotation axis of the fixing roller 1', similarly to the heater 6 shown in FIG. 4.

The volume of the rubber layer 13' of the fixing roller 1' is larger than the volume of the rubber layer 14 of the press roller 2 in the fixing device 70 shown in FIG. 7. Each of the rubber layers 13' and 14 are made of a rubber material (e.g., silicon rubber) having the same heat conduction. Accordingly, the heat capacity of the fixing roller 1' is larger than that of the press roller 2, because the volume of the rubber layer 13' is larger than the rubber layer 14.

The temperature distribution of the fixing roller 1' is higher in the edge portions than in the center portion with respect to the direction of the rotation axis of the fixing roller 1' when the sheet P is not fed into the nipping area 5, that is, when the image forming apparatus 100 is in standby state. This is because the heat quantity per unit area of the heater 6 is higher in the edge portions than in the center portion with respect to the direction of the rotation axis of the fixing roller 1'. In addition, the temperature of the edge portions of the fixing roller 1' can be easily maintained within a predetermined temperature range because the heat capacity of the fixing roller 1' is larger than that of the press roller 2.

As described above, the heater 6 has a heat quantity per unit area higher in the edge portions than in the center portion with respect to the direction of the rotation axis of the fixing roller 1'. The heater 6 is arranged in the fixing roller 1', which has a heat capacity higher than the press roller 2. Accordingly, the temperature in the edge portions of the nipping area 5 does not decrease very much, even when a heater 7', whose heat quantity per unit area is higher in a center portion than in edge portions and whose electricity consumption is relatively low, is used in the press roller 2. Therefore, problems associated with fixing when the sheet P begins to pass through the nipping area 5 can be avoided.

As described above, fixing characteristics can be improved, especially in the edge part of the nipping area 5, and electricity consumption of the fixing device 70 can be decreased when the sheet P passes through the nipping area 5.

Figure 8:
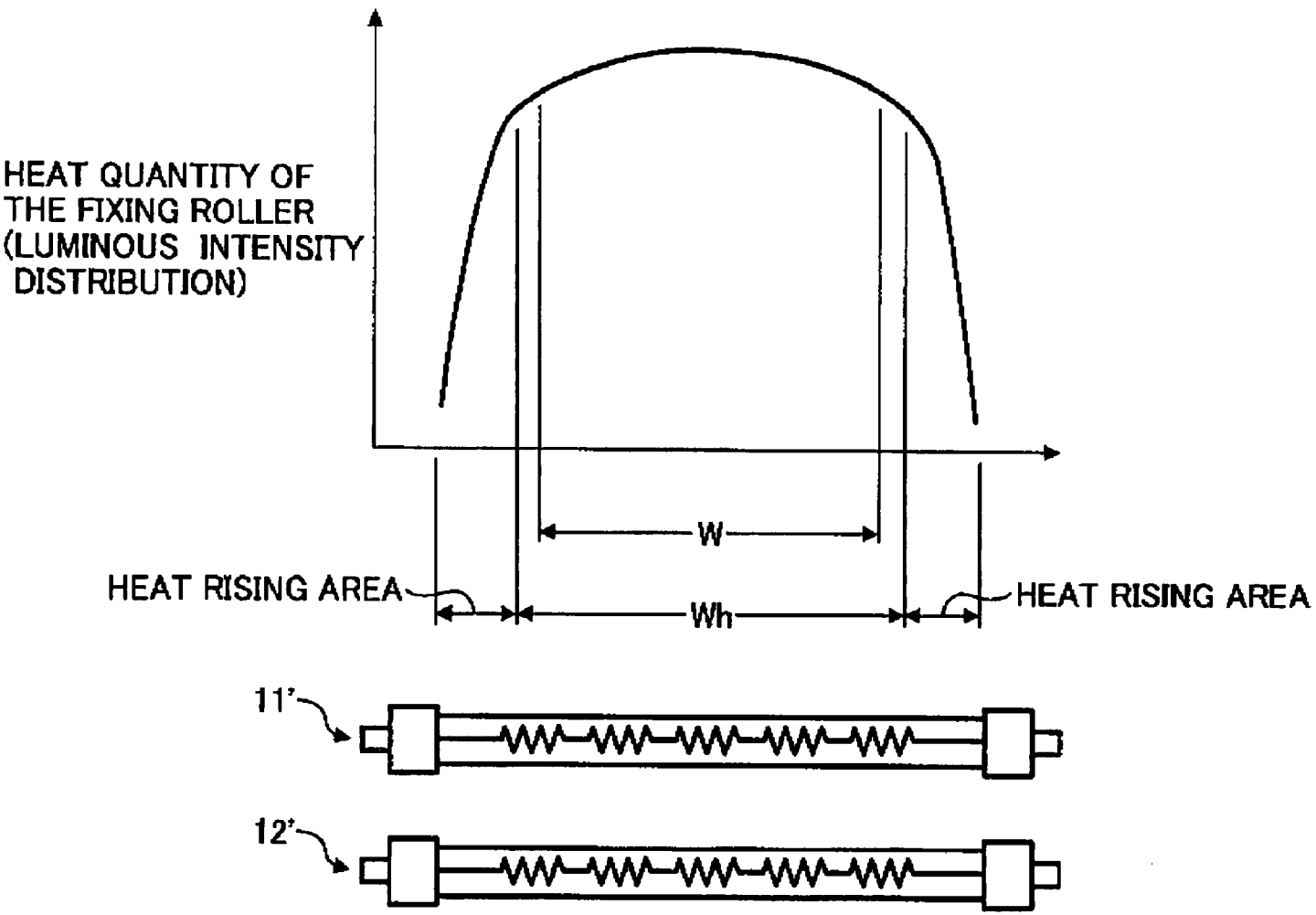
FIG. 8 is a chart illustrating distribution of a heat quantity from a second heat unit and a schematic view of the second heat unit of FIG. 8.

FIG. 8 illustrates distribution of the heat quantity from the second heat unit (i.e., heaters 11 and 12) along with a view of the second heat unit according to a further aspect of the present invention. In this aspect, an active heat area of the second heat unit is set. The active heat area of the heaters 11' and 12' is represented by Wh in FIG. 8 and is arranged between heat rising areas and within an area in which the heat quantity is substantially stable. The width of the active heat area Wh is set broader than the largest sheet width W, and the active heat area Wh includes the area corresponding to the largest sheet width W. Halogen heaters are used for the heaters 11' and 12' and the heat quantity per unit area of the heaters 11' and 12' is lower in the edge part than in the center part in the direction of the rotation axis of the heat roller 8.

By the way, in a halogen heater, when the heat quantity is made to be smaller in a predetermined position relative to another position with respect to a longitudinal direction (e.g., the direction of the rotation axis of the roller), the roll pitch of the tungsten filament in the heater is made to be larger in the predetermined position than the other position. The heat quantity of the halogen heater at each position in a longitudinal direction is estimated by measuring the luminous intensity distribution, generally.

When the heat quantity per unit area of the heaters 11' and 12' is lower in the edge portions than in the center portion by making the roll pitch of the tungsten filament larger in the edge portions, the luminous intensity in the center portion is different from the luminous intensity in the edge portions. As such, measuring luminous intensity distribution of each halogen heater manufactured can be difficult.

Accordingly, referring to FIG. 8, the width of the heat rising areas (corresponding to luminous intensity rising areas) of the heaters 11' and 12' is estimated, and the active heat area Wh of the heaters 11' and 12' is arranged in the area out of and between the heat rising areas, in which the heat quantity is substantially stable. The width of the heat rising area is 20 mm in this aspect, but can be alternatively another width, depending on the requirements of the fixing device 70. The width of the active heat area Wh is set to be longer than the largest sheet width W.

The active heat area Wh is set narrower than the width of the rollers 11' and 12' by adding the length corresponding to the width of the heat rising area (e.g., 20 mm each) to both sides of the largest sheet width W. In addition, the width of the heat rising area 20 mm is obtained by the result of experiments.

As described above, the active heat areas Wh of the heaters 11' and 12' are arranged in the area out of the heat rising areas, and are arranged in the area in which the heat quantity is substantially stable. Further, the width of the active heat area Wh is set to be longer than the largest sheet width W in this aspect. Accordingly, the luminous intensity in the edge portions of the active heat areas Wh is almost the same as the luminous intensity in the center portion of the active heat areas Wh. Therefore, measuring the luminous intensity distribution of each of the heaters 11' and 12' is not necessary.

In this aspect, fixing characteristics can also be improved, especially in the edge portions of the nipping area 5, and the electricity consumption of the fixing device 70 can also be decreased when the sheet P passes through the nipping area 5, as described above.

Figure 9:
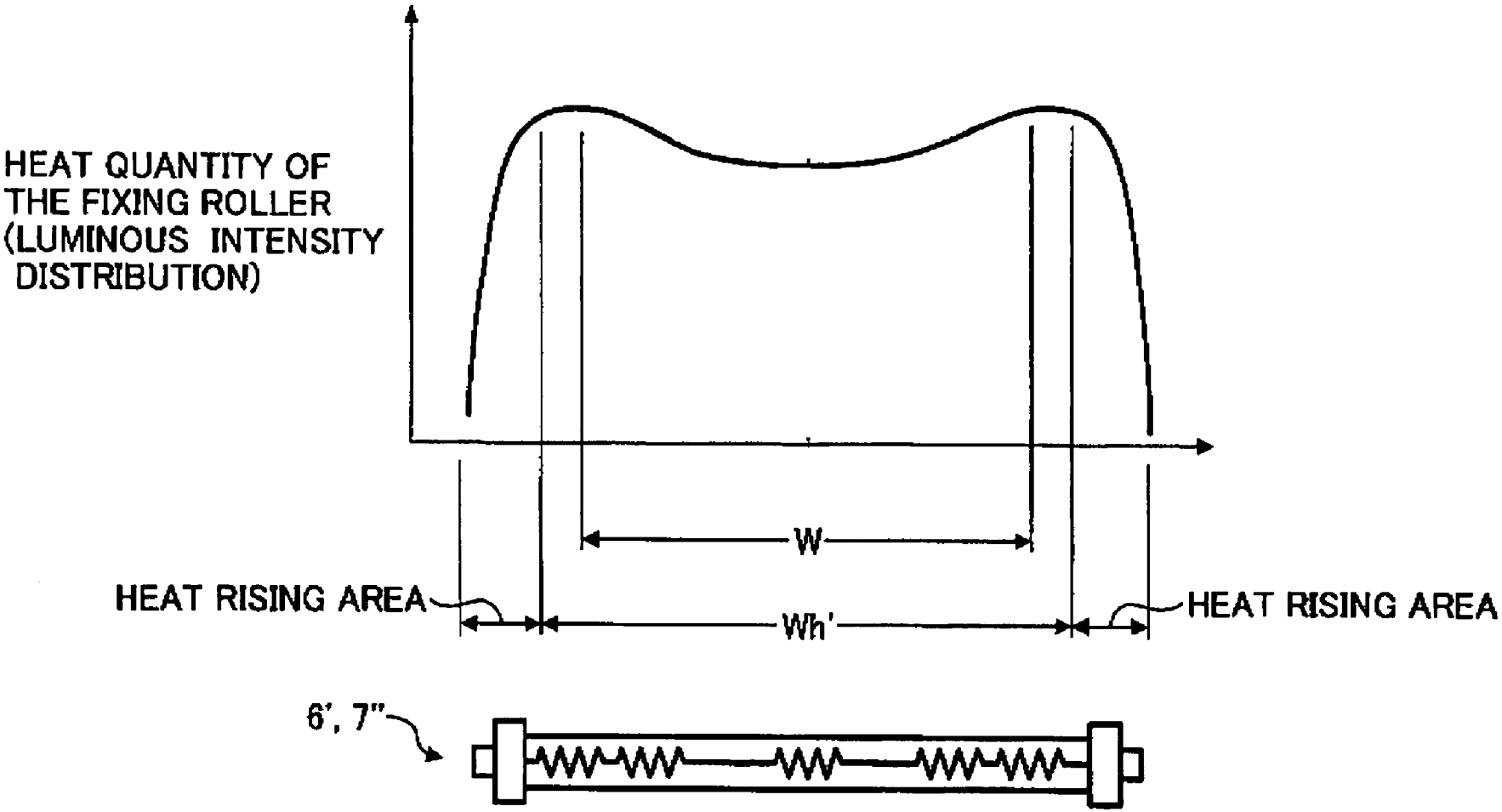
FIG. 9 is a chart illustrating distribution of a heat quantity from a first heat unit and a schematic view of the first heat unit of FIG. 8.

FIG. 9 illustrates a distribution of the heat quantity from the first heat unit (i.e., either heater 6' or 7") along with a view of the first heat unit according to another aspect of the present invention. In this aspect, an active heat area of the second heat unit is set.

The active heat area Wh' of the heater 6' arranged in the fixing roller 1 (see FIG. 2) is set in an area out of and between heat rising areas, and is set in an area in which the heat quantity is substantially stable. The width of the active heat area Wh' is set to be longer than the largest sheet width W, and the active heat area Wh' includes the area corresponding to the largest sheet width W.

In addition, this aspect is also applicable to a configuration in which the heater 7' in the press roller 2 is used as the first heat unit, by making the heater 7' in the same way as the heater 6' in this embodiment.

A halogen heater is used for the heater 6'. The heat quantity per unit area of the heater 6' is higher in the edge portions than in the center portion with respect to the direction of the rotation axis of the fixing roller 1.

[The heat quantity per unit area of the heater 6 is higher in the edge part than in the center part by making the roll pitch of the tungsten filament be smaller in the edge part than in the center part, in this embodiment]. Accordingly, the luminous intensity in the center portion is different from the luminous intensity in the edge portions. As such, measuring luminous intensity distribution of each halogen heater manufactured can be difficult.

Accordingly, the width Wh' of the heat rising area (corresponding to a luminous intensity rising area) of the heater 6' is estimated, and the active heat area Wh' of the heater 6' is arranged in the area out of the heat rising areas, in which the heat quantity is substantially stable. The width of the heat rising area is 40 mm in this aspect, and the width of the active heat area Wh' is set to be longer than the largest sheet width W.

The active heat area Wh' is set narrower than the total width of the heater 6' by adding the length corresponding to the width of the heat rising area (40 mm each) to both side of the largest sheet width W. In addition, the width of the heat rising area of 40 mm is obtained by the result of experiments.

As described above, the active heat area Wh' of the heaters 6' is arranged in the area out of the heat rising areas, and is arranged in an area in which the heat quantity is substantially stable. Also, the width of the active heat area Wh' is set to be longer than the largest sheet width W in this embodiment. Accordingly, the luminous intensity in the edge portions of the active heat area Wh' is almost the same as the luminous intensity in the center portion of the active heat area Wh'. Therefore, measuring the luminous intensity distribution of each of the heater 6' is not necessary.

In this aspect, fixing characteristics can also be improved, especially in the edge part of the nipping area 5, and the electricity consumption of the fixing device 70 can also be decreased when the sheet P passes through the nipping area 5, as described above.

Figure 10:
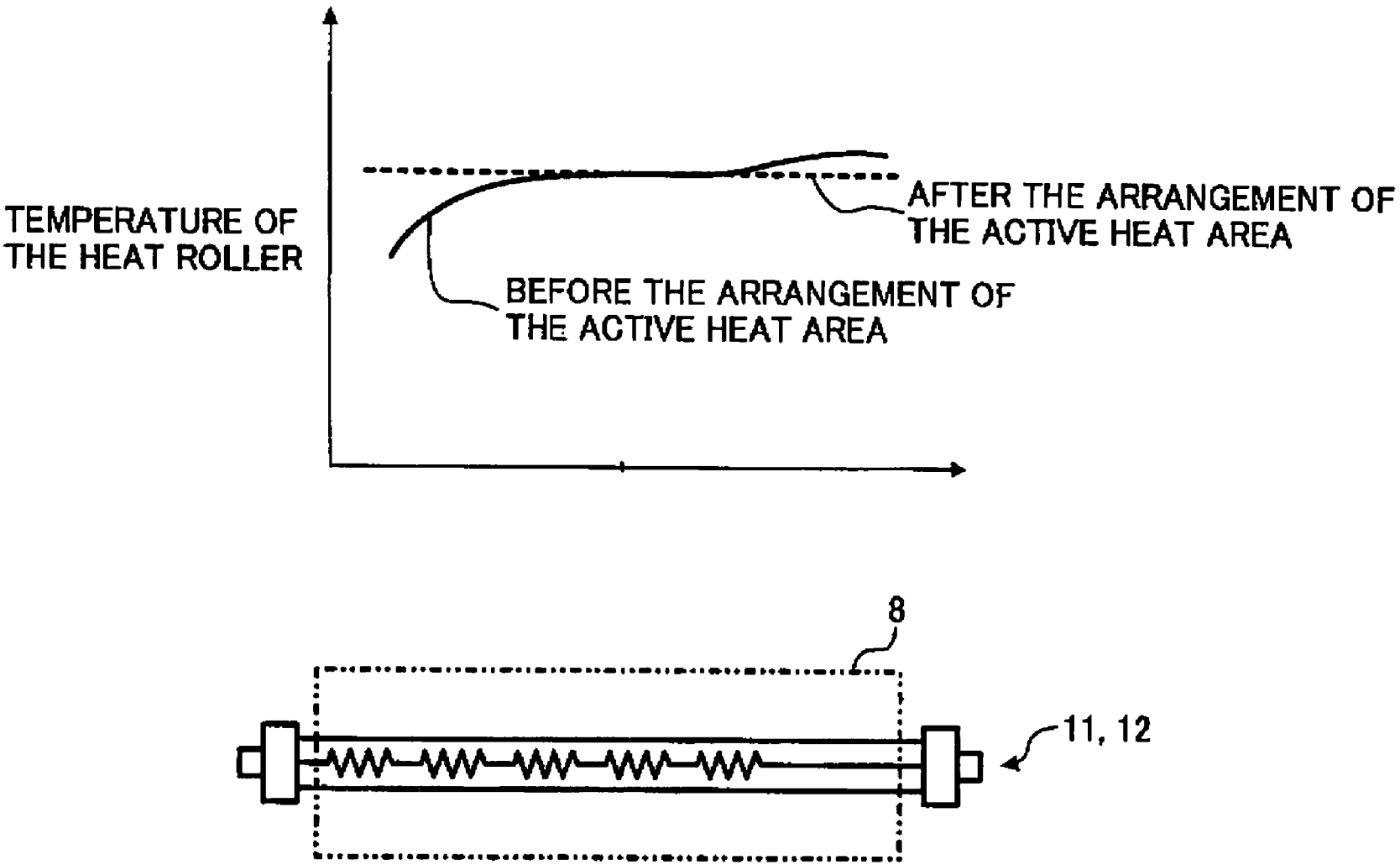
FIG. 10 is a chart illustrating distribution of a heat quantity from a second heat unit and a schematic view of the second heat unit in accordance with a further aspect of the present invention.

FIG. 10 illustrates a distribution of the heat quantity from the second heat unit (i.e., heaters 11 and 12) along with a view of the second heat unit according to another aspect of the present invention. In this aspect, the center of the active heat area of the second heat unit is displaced along the direction of the rotation axis of the roller.

The temperature near one edge of a heat roller can decrease at a greater rate than the other edge. To address this, as shown in FIG. 10, the center of the active heat area of heaters 11 and 12 is shifted from the center of the heat roller 8 towards the edge where a temperature decreasing rate is higher.

Referring to the solid line shown in FIG. 10, the temperature of the left edge of the heat roller 8, as shown in FIG. 10, is lower than that of the right edge of the heat roller 8. This occurs because the left side of the heat roller 8 is connected to a gear that draws heat away from the left side of the heat roller 8.

In this aspect, the center of the active heat area of heaters 11 and 12 is arranged away from the center of the heat roller 8 and towards the left edge of the heat roller 8, where the temperature is lower than the right edge. Accordingly, the temperature of the heat roller 8 in both edge portions becomes substantially the same, as shown by the broken line in FIG. 10.

In this way, a temperature difference between the edge portions of the heat roller 8 can be decreased. In this aspect, fixing characteristics can also be improved, especially in the edge part of the nipping area 5, and the electricity consumption of the fixing device 70 can also be decreased when the sheet P passes through the nipping area 5, as described above.

It is to be understood that the present invention is not limited to the above described aspects. Numerous variations and modification may be made without departing from the scope of the present invention.

What is claimed is:

1. An image forming apparatus comprising:

a fixing device including, a rotation body, a fixing belt arranged around the rotation body, a facing unit configured to face the rotation body, a first heat unit configured to heat a nipping area formed between the rotation body and the facing unit, a second heat unit configured to heat the nipping area, a high heat capacity unit configured to transfer heat from the first heat unit to the nipping area, a low heat capacity unit configured to transfer heat from the second heat unit to the nipping area, and a heat quantity controller configured to control heat quantity of the first heat unit and of the second heat unit, wherein, the first heat unit is configured to heat an edge portion and a center portion of the nipping area such that a heat quantity per unit area in an edge portion of the nipping area is higher than a heat quantity per unit area in a center portion of the nipping area, and the second heat unit is configured to heat the edge portion and the center portion of the nipping area such that the heat quantity per unit area in the edge portion is lower than the heat quantity per unit area in the center portion.

2. A fixing method comprising:

arranging a fixing belt around a rotation body;

disposing a facing unit to face the rotation body to form a nipping area;

heating the nipping area through a high heat capacity unit such that a heat quantity per unit area in an edge part of the nipping area is higher than a heat quantity per unit area of a center part of the nipping area; and heating the nipping area through a low heat capacity unit such that the heat quantity per unit area in the edge part is lower than the heat quantity per unit area in the center part.

3. The fixing method of claim 2, further comprising:

providing a fixing roller in the rotation body;

providing a press roller in the facing unit; and arranging the fixing belt around the fixing roller and a heat roller, wherein, heating the nipping area through the high heat capacity unit includes providing heat from at least one of the fixing roller and the press roller, and heating the nipping area through the low heat capacity unit includes providing heat from the heat roller.

4. A fixing method according to claim 3, wherein one of the fixing roller and the press roller has a higher heat capacity than the other one of the fixing roller and the press roller, and includes the high heat capacity unit.

5. A fixing method according to claim 3, wherein heating through the low heat capacity unit includes heating the nipping area such that a center of an active heat area in which heat quantity per unit area is substantially stable is arranged away from a center of the heat roller in a direction of a rotation axis of the heat roller.

6. A fixing method according to claim 3, wherein the heating step through the high heat capacity unit includes heating the nipping area such that a center of an active heat area in which heat quantity per unit area is substantially stable is arranged away from a center of the roller in which the first heat unit is arranged in a direction of a rotation axis of the roller.

7. The fixing method of claim 3, further comprising:

heating through the high heat capacity unit such that an amount by which the heat quantity per unit area in the edge portion is greater than the heat quantity per unit area in the center portion when a sheet is not positioned in the nipping area is larger than an amount by which the heat quantity per unit area in the edge portion is greater than the heat quantity per unit area in the center portion when the sheet is positioned in the nipping area.

8. A fixing method according to claim 2, wherein heating through the low heat capacity unit includes heating an area of the nipping area with a width larger than a largest sheet width with substantially the same heat quantity per unit area.

9. A fixing method according to claim 2, wherein heating through the high heat capacity unit includes heating an area of the nipping area with a width larger than a largest sheet width with substantially the same heat quantity per unit area.

10. The fixing method of claim 2, further comprising:

heating the nipping area such that an amount by which the heat quantity per unit area in the edge portion is greater than the heat quantity per unit area in the center portion when a sheet is not positioned in the nipping area is larger than an amount by which the heat quantity per unit area in the edge portion is greater than the heat quantity per unit area in the center portion when the sheet is positioned in the nipping area.

11. A image forming method comprising:

transferring a toner image to a sheet; and fixing the toner image to the sheet by, arranging a fixing belt around a rotation body, disposing a facing unit to face the rotation body to form a nipping area, heating the nipping area through a high heat capacity unit such that a heat quantity per unit area in an edge part of the nipping area is higher than a heat quantity per unit area of a center part of the nipping area, heating the nipping area through a low heat capacity unit such that the heat quantity per unit area in the edge part is lower than the heat quantity per unit area in the center part, and delivering the sheet to the nipping area.

* * * * *